US006692103B2

(12) United States Patent
Okuda et al.

(10) Patent No.: US 6,692,103 B2
(45) **Date of Patent: *Feb. 17, 2004**

(54) INK JET RECORDING HEAD

(75) Inventors: Masakazu Okuda, Tokyo (JP); Yasuhiro Otsuka, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/140,621

(22) Filed: May 7, 2002

(65) Prior Publication Data

US 2002/0180831 A1 Dec. 5, 2002

(30) Foreign Application Priority Data

May 8, 2001 (JP) ..... 2001-137848

(51) Int. Cl.[7] ..... B41J 2/145; B41J 2/15; B41J 2/14; B41J 2/16

(52) U.S. Cl. ..... 347/40; 347/47

(58) Field of Search ..... 347/40, 47

(56) References Cited

U.S. PATENT DOCUMENTS 6,126,339 A * 10/2000 Kobayashi ..... 396/626

FOREIGN PATENT DOCUMENTS

| | | | | |
|---|---|---|---|---|
| JP | S53-12138 B | | 4/1978 | |
| JP | S56-93567 A | | 7/1981 | |
| JP | S57-107849 A | | 7/1982 | |
| JP | 59-190862 A | * | 10/1984 | ..... 347/43 |
| JP | S62-196155 A | | 8/1987 | |
| JP | S63-13751 A | | 1/1988 | |
| JP | H6-286138 A | | 10/1994 | |
| JP | H10-193587 A | | 7/1998 | |

* cited by examiner

*Primary Examiner*—Thinh Nguyen
(74) *Attorney, Agent, or Firm*—Scully, Scott, Murphy & Presser

(57) ABSTRACT

An ink jet recording head wherein a nozzle jetting ink droplets is structured of a plurality of ink jet ports 11, and the length $l_n$ [m] of an ink jet port and pitch $P_n$ [m] are set to satisfy the conditions $l_n > 1.2\ V_d/A_n$ and $P_n > 1.4\ d_d$ (where $V_d$ is the volume of ink droplets that are jetted from one individual ink jet port [$m^3$], $d_d$ is diameter of an ink droplet [m] and $A_n$ is the area of a nozzle opening [$m^2$]); wherein the fusion phenomena of a meniscus at the rear surface of a nozzle after ink is jetted can be suppressed; and wherein the effect of a multi-port nozzle enabling re-fill time to be reduced is utilized. Further the fusion phenomena of ink jet droplets in flight after being jet expelled from a multi-port nozzle can be suppressed enabling superior quality images to be recorded.

15 Claims, 11 Drawing Sheets

| ink jet port pitch [μm] | 5 | 6 | 7 | 8 | 9 | 10 | 11 | 12 |
|---|---|---|---|---|---|---|---|---|
| 40 | ◎ | ◎ | ◎ | ◎ | ◎ | ○ | ○ | ○ |
| 35 | ◎ | ◎ | ○ | ○ | ○ | △ | △ | × |
| 30 | ○ | ○ | △ | △ | △ | × | × | ×× |
| 25 | △ | × | × | × | ×× | ×× | ×× | ×× |

droplet volume Vd [pl]

INK JET RECORDING HEAD

BACKGROUND OF THE INVENTION

1. Field of the Invention

The present invention relates to an ink jet head for recording text or an image, etc., by jetting ink from a nozzle and an ink jet recording device.

2. Description of Related Art

Among the prior arts, structures disclosed in for example JP S53-12138B or JPH10-193587A are generally well-known. These involve utilizing an electromechanical conversion mechanism such as a piezo-electric actuator for example for a pressure generating mechanism, generating pressure waves in an ink filled pressure generating chamber and using a drop on demand type ink jet recording head for jetting ink droplets from a nozzle communicating with the pressure generating chamber through the pressure waves.

FIG. 11 is a cross-sectional drawing showing in outline the structure of an existing ink jet recording head among the prior arts. Referring to FIG. 11, ink pressure generating chamber 111, nozzle 112 for jetting ink is connected to ink supply passages 114 for channeling ink from an ink tank shown in the lower part of the drawing via common ink passages 113. Further, vibration plate 115 is provided on the bottom of pressure generating chamber 111.

When ink droplets are jetted, piezo-electric actuator 116 on the outside of pressure generating chamber 111 causes this vibration plate 115 to be displaced. This in turn creates a change in the volume inside pressure generating chamber 111 thereby generating pressure waves inside that chamber. The effect of these pressure waves causes some of the ink filled in pressure generating chamber 111 to be jet discharged through nozzle 112, jetting out as ink droplets 117. These ink droplets 117 expelled in a jet form dots as they contact a recording medium such as paper etc. Repeating the formation of these; recording dots based on image data enables text or an image to be recorded on to the recording medium.

FIGS. 12*a* through 12*f* illustrate how a meniscus of a nozzle portion behaves before and after jetting ink. As shown in FIG. 12*a*, meniscus 122 that is initially substantially flat, moves towards the outside of nozzle 121 as the pressure generating chamber is compressed causing ink droplets 123 to be jetted (FIG. 12*b*). As ink droplets are jet expelled the volume of ink inside nozzle 121 decreases forming a concave shape in meniscus 122. As shown in FIGS. 12*d* through 12*f*, this concave shaped meniscus 122 gradually regresses towards the opening portion of nozzle 121 due to the action of the elastic surface of the ink, returning back to the original condition before ink was jetted. In this description, this regressing action of a meniscus after ink is jetted is referred to as a "re-fill" and the time taken for a meniscus to first regress back to the opening portion (y=0) after ink is jetted is called "re-fill time ($t_r$)."

When ink droplets are continuously jetted, a subsequent ink jetting occurs even before a re-fill is completed leading to inconsistency in diameter and speed of the droplets. If a subsequent jetting of ink is not performed after completion of a re-fill it is not possible to achieve stable and continous ink jetting. In other words, if after ink is jetted more than re-fill time $t_r$ does not elapse before the next ink jetting that next ink jetting cannot be carried out smoothly. Accordingly, reducing re-fill time $t_r$ is an important point for increasing maximum jet frequency (i.e. recording speed).

JP S56-93567A, JP S57-107849A and JP S63-13751A for example, disclose ink jet recording heads having a nozzle provided with multiple ink jet ports 131 in nozzle plate 132 as shown in FIGS. 13*a* and 13*b* as a means for reducing this re-fill time. In other words, this re-fill activity described above is something that operates through pressure arising through the elastic surface of meniscus. As shown in the following formula, the smaller the acoustic capacity $c_n$ the greater the pressure arising ($d_n$ is nozzle diameter [m], $\sigma$ is ink surface elasticity [N/m].

$$C_n = \frac{\pi d_n^4}{64\sigma}\sqrt{1 + \frac{16y^2}{d_n^2}} \tag{1}$$

As illustrated by that formula, as this meniscus acoustic capacity $c_n$ is the fourth power of nozzle diameter, nozzle diameter should be made as small as possible in order to reduce acoustic capacity $c_n$. However, if the nozzle diameter of a nozzle with a single port is reduced other problems arise such as a decrease in the volume of ink droplets.

Accordingly, as shown in FIGS. 13*a* and 13*b*, where a nozzle is formed with multiple ink jet ports 131 in which the diameter of the openings is small, extremely minute droplets are jetted from each ink jet port but there is no increase in the total volume of ink droplets expelled, while acoustic capacity $c_n$ of each ink jet port decreases allowing for an increase in re-fill speed.

Other points of ink jet recording heads having multiple openings to decrease the re-fill time include improved gradient recordability as disclosed in JP H6-286138A, faster printing of a specific pattern such as a bar-code etc. as disclosed in JP S62-196155A for example, or prevention of rear surface recording or improved drying properties through a specified reduction in ink droplet volume as disclosed in JP S56-93567A, The results of analysis conducted by the inventors of those inventions on experimental ink jet recording heads with multiple ports made it clear however, that in addition to it being difficult to obtain sufficiently reduced re-fill time simply by having a nozzle with a multi-port structure, a multi-port nozzle creates other problems inducing image quality to fall or ink jet properties to deteriorate (deteriorating ink jet efficiency etc.). The results of analysis of multiple assessments conducted on experimental heads and flow analysis to ascertain the causes, clearly showed that problems lay with nozzle structure; length of a nozzle and pitch of ink jet ports etc. and matching with other passage systems. In other words, it became clear that obtaining the optimum nozzle structure and more efficiently matching different passages are indispensable for more effectively bringing out the benefits of a multi-port nozzle. These issues will now be further described with reference to concrete examples.

FIG. 14 shows an example of results obtained investigating the relationship between volume of jetted ink droplets and re-fill time in an existing ink jet recording head having a multi-port nozzle with 5 ink jet ports. Results for an ink jet recording head where a nozzle has multiple ports are plotted with black triangles and these results are compared to those obtained from an ink jet recording head with a mono-port nozzle having just one ink jet port, plotted with circles. For this comparison the total volume of ink droplets used was the same for both types of head.

FIG. 14 clearly shows that when ink droplet volume is 5 pl or less re-fill time of a multi-port nozzle was ½ to ⅔ that of a mono-port nozzle, and the effect of a multi-port nozzle is to decrease re-fill time; increase re-fill speed.

If however ink droplet volume exceeds 5 pl re-fill time is non continuous and increases dramatically, becoming longer than re-fill time for a mono-port nozzle. In other words, it became clear that if ink droplet volume exceeds a specific point, more than just losing the effects of decreased re-fill time, re-fill speed of a multi-port nozzle fell below that of a mono-port nozzle.

Thus, the results of investigating the causes of substantial change in re-fill time in relation to ink droplet volume through conducting experiments and flow analysis etc. clearly show that the condition of the meniscus on a rear surface of a nozzle has a substantial effect. In other words, if the length of an ink jet port is small in relation to the volume of ink droplets discharged, as shown in FIG. 15*b*, it is clear that a fusion phenomena occurs affecting meniscus 155 at the rear surface of a nozzle. Because this phenomenon causes the radius of curvature of the meniscus to increase, regression of the meniscus, the driving force of a re-fill operation, decreases, resulting in substantially increased re-fill time.

The substantial increase in re-fill time as droplet volume exceeds 5 pl in FIG. 14 is believed to occur as, in line with an increase in ink droplet volume, there is an increase in the scale of backward regression of a meniscus immediately after jetting action, and a fusion phenomena of the meniscus occurs at the rear surface of a nozzle. On the other hand, it appears that where droplet volume is below 5 pl the scale of regression of a meniscus is smaller and as shown in FIG. 15*a* a normal meniscus 154 is formed.

The fusion phenomena of a meniscus at the rear surface of a nozzle described above can be prevented by making ink jet ports sufficiently long, however increasing the length of ink jet ports leads to an increase in re-fill time due to a different reason. That is to say, because acoustic resistance (flow resistance) of an ink jet port is relative to the length of the ink jet port, if the length of an ink jet port is made long the acoustic resistance increases resulting in an increase in re-fill time. Especially in the case of a multi-port nozzle, because the diameter of the ink jet ports is small, acoustic resistance increases easily as the scale of the resistance is an inverse ratio of the fourth power of diameter of the passage of flow. Thus, unless the length of an ink jet port is made as small as possible it is extremely difficult to realize high-speed re-filling.

Accordingly, realizing high-speed re-filling through a multi-port nozzle requires that the length of the ink jet ports be set at the optimum value. Among the prior arts for multi-port nozzles however, nothing exists to resolve the issues stemming from the length of the ink jet ports and the optimum scale for the length of an ink jet port remains unclear.

Another issue affecting ink jet recording heads of the prior arts will now be described. This is the fusion phenomena of droplets as ink droplets undergo the process of being jetted. Ink jet recording heads of the prior arts having multi-port nozzles, like those disclosed in JP S63-13751A and JP H6-286138A, have fusion occurring in the jetting process as ink droplets are discharged from an ink jet port. To realize the effects of a specified reduction in ink droplet volume, improving drying properties and preventing rear surface recording etc. ink droplets jetted from an ink jet port can each be applied individually to the recording medium as disclosed in JP S56-93567A.

Results of actual recording experiments using ink jet recording heads having multi-port nozzles however, clearly indicate that ink droplets jetted from each ink jet port fuse together very easily while flying out during the jetting out process leading to substantial variation in ink droplet volumes as the ink is applied to the recording medium.

For example, with each ink jet port jetting droplets of 4 pl, if 2 droplets fuse together while flying out that creates 8 pl and if 3 droplets fuse, 12 pl. Viewing results of actual recordings assessed shows that variations of 30–60 $\mu$m occur in diameter of dots formed on a paper recording medium, so we can estimate that a maximum of 5 droplets can be fused together during this flying out process of jetted ink droplets.

This phenomenon of ink droplets fusing together leads to a remarkable deterioration in image quality of recordings made. That is to say, because diameter of recorded dots increases within a region where the appearance of this phenomenon of fusion of ink droplets is prevalent, a grainy appearance within an image increases creating very rough qualities in the image. Further, as the dots become more sparsely dispersed the consistency of the image becomes less dense. The phenomena of fusion of ink droplets does not occur uniformly over the surface of an image recorded so the phenomena of increased graininess and deteriorating density does not occur uniformly across the surface of the image, resulting in acute unevenness in the image output. This uneven image quality, especially when a photographic image is output, leads to severe deterioration of the quality of the image.

The first reason that the ink droplet fusion phenomena described occurs easily in an ink jet recording head having a multi-port nozzle is that the space existing between ink droplets in flight while being jetted is extremely small. This means an ink jet recording head with a multi-port nozzle has a plurality of tiny ink jet ports arranged at only a very small distance from each other (pitch $P_n$ in FIG. 13*b*) so immediately after ink droplets are discharged the droplets jetted from each ink jet port are extremely close to each other and therefore in a condition in which it is extremely easy for them to come into contact with each other (see FIG. 15*b*). Once flying ink droplets come into contact with each other two droplets fuse into one due to the action of surface elasticity of ink, and continue their flight as one ink droplet. In other words, in a multi-port nozzle jetting out a plurality of ink droplets spaced with only a small interval between those droplets, it is extremely easy for the ink droplet fusion phenomena to occur.

The second reason that the ink droplet fusion phenomena occurs easily is due to the effect of airflow in the space between the head and paper recording medium. This means ink droplets jetted from an ink jet port are affected by air flows in between the head and recording paper as droplets fly when jetted and as ink droplets jetted from a multi-port nozzle are generally extremely small (normally 15 pl or below), those droplets are easily affected by air flows. Because inconsistencies in both time and space arise in air flows between a head and recording paper the flight path of each ink droplet undergoes minute changes. The result leads to a perception that this makes it extremely easy for the ink droplet fusion phenomena to occur.

As described, suppression of this phenomenon of fusion between ink droplets is indispensable for realizing recording of high quality images with an ink jet recording head having a multi-port nozzle. In ink jet recording heads of the prior arts having a multi-port nozzle however, the problem remains that it is difficult to realize high quality recording of images as no device for suppressing the ink droplet fusion phenomena is employed.

Thus problems with recording heads of the prior arts having a multi-port nozzle are firstly the fusion phenomena of a meniscus at the rear surface of a nozzle and secondly the fusion phenomena affecting ink droplets flying as they are jetted.

As described, in principle a variety of different benefits are anticipated from a multi-port nozzle like faster re-filling and a specified reduction in ink droplet volume. Nonetheless, it is believed that the problems described above are the reason that an ink jet recording head utilizing a multi-port nozzle is yet to be realized.

SUMMARY OF THE INVENTION

The present invention has been formed to resolve the problems described above and to realize to the maximum, the faster re-filling speed that is the benefit of a multi-port nozzle. A first object of the present invention is to provide an ink jet recording head that realizes faster recording than that achieved by ink jet heads of the prior arts and to provide an ink jet recording device.

A second object of the present invention is to prevent, in an ink jet head having a multi-port nozzle, the fusion phenomena affecting ink droplets flying as they are being jetted, to provide an ink jet recording head that realizes recording of excellent quality images and to provide an ink jet recording device.

According to a first aspect of the present invention an ink jet recording head is provided wherein pressure changes are induced in an ink filled pressure generating chamber through a pressure generating means and ink droplets are jetted from a nozzle communicating with the pressure generating chamber, which nozzle is structured of a plurality of ink jet ports, the length of which ports $l_n$ [m] is set in accordance with the following conditions.

$$l_n > 1.2 V_d / A_n \quad (2)$$

where $V_d$ is the volume of ink droplets that are jetted from one individual ink jet port [$m^3$] and $A_n$ is the area of a nozzle opening [$m^2$].

It is preferable for the length $l_n$ [m] of an ink jet port to conform to the following conditions.

$$l_n < 4.0 V_d / A_n$$

According to a second aspect of the present invention an ink jet recording head is provided wherein pressure changes are induced in an ink filled pressure generating chamber through a pressure generating means and ink droplets are jetted from a nozzle communicating with the pressure generating chamber, which nozzle is structured of a plurality of ink jet ports, the interval between which ports $P_n$[m] is set in accordance with the following conditions.

$$P_n > 1.4 d_d \quad (3)$$

where $d_d$ is diameter [m] of an ink droplet jetted from an ink jet port.

According to a third aspect of the present invention an ink jet recording head is provided wherein pressure changes are induced in an ink filled pressure generating chamber through a pressure generating means and ink droplets are jetted from a nozzle communicating with the pressure generating chamber, which nozzle is structured of a plurality of ink jet ports the openings of which ports are of various diameters.

According to a fourth aspect of the present invention an ink jet recording head is provided wherein pressure changes are induced through a pressure generating means in an ink filled pressure generating chamber that is connected to a nozzle and ink supply passages, the nozzle is structured of a plurality of ink jet ports and the inertance mi of ink supply passages is set in accordance with the following conditions.

$$1.5 \leqq m_n / (N/m_i) \leqq 1.5 \quad (4)$$

where $m_n$ is the inertance of an ink jet port and N is the number of ink jet ports.

It is preferable for the structure described above, that the volume of ink droplets $V_d$ jetted from an ink jet port be set in accordance with the following conditions.

$$1.1 V_d' / N^{3/2} < V_d < 1.8 V_d' / N^{3/2}$$

where $V_d'$ is required ink volume when ink droplets are jetted from a single ink jet port.

Further, it is preferable for the speed of jetted ink droplets to be set to 5 m/s or above.

The nozzles may be arranged in a two dimensional matrix.

There may be three or more ink jet ports.

The ink jet ports may be formed by laser processing.

An ink jet port may be arranged in relation to the recording resolution of the scanning direction and sub-scanning direction of the head such that recording dots formed from ink droplets jetted from that port are arranged on the recording medium at substantially even intervals.

This invention was produced based on results obtained from assessments conducted on experimental heads that clearly showed that the length of ink jet ports is extremely important for reducing re-fill time of an ink jet recording head having a multi-port nozzle. Basically, the setting of the length of an ink jet port is critical for preventing a fusion phenomena of a meniscus at the rear surface of a nozzle and for enabling the increase in acoustic resistance in a nozzle to be suppressed. For an ink jet recording head according to the present invention, ink jet port length $l_n$ is set to comply with conditions of equation (2) based on ink droplet volume $V_d$ and ink jet port opening diameter $A_n$, thereby making possible both prevention of the fusion phenomena of a meniscus and suppression of the increase in acoustic resistance.

Again, this invention was produced based on the fact that a fusion phenomena of droplets occurring as ink droplets fly out during the jetting process causes a deterioration in image quality when an ink jet recording head having a multi-port nozzle is used for recording an image. For an ink jet recording head according to the present invention the interval $P_n$ between ink jet ports is set to comply with conditions of equation (3) based on ink droplet diameter $d_d$, thereby suppressing the fusion phenomena of droplets as ink droplets fly out during the jetting process so that a superior quality of image can be obtained.

Again, with an ink jet recording head according to the present invention, maximization of re-fill speed is achieved through optimizing the matching between a multi-port nozzle and the characteristics of other flow passages. That is to say, inertance $m_i$ of ink supply passages is set to comply with conditions of equation (4), thereby enabling reduction of re-fill time without a deterioration in jetting efficiency and further increasing recording speed beyond that obtainable from a nozzle simply structured with multiple ports.

BRIEF DESCRIPTION OF THE DRAWINGS

Specific embodiments of the present invention will now be described, by way of example only, with reference to the accompanying of drawings in which.

DETAILED DESCRIPTION OF THE PREFERRED EMBODIMENTS

Figure 1A:
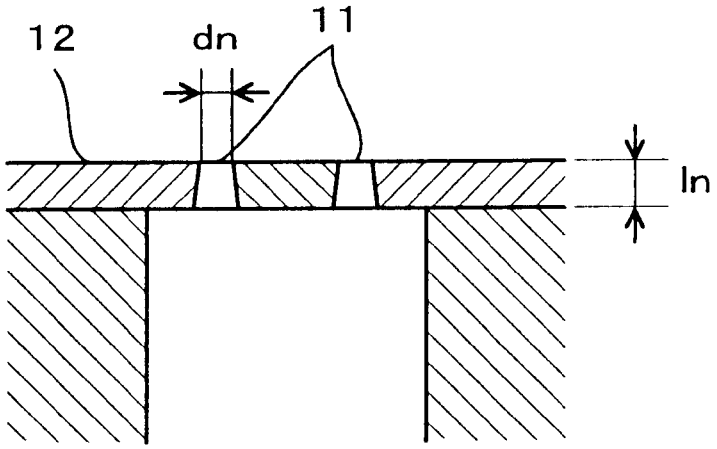
FIG. 1*a* and FIG. 1*b* show the structure of a nozzle of an ink jet recording head according to the first embodiment of the present invention.
Figure 1B:
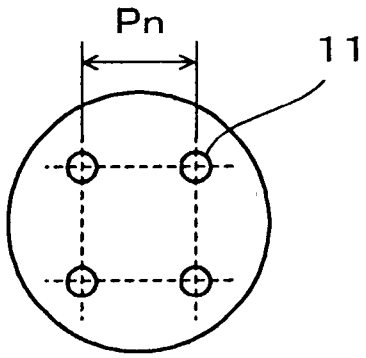
Figure 11:
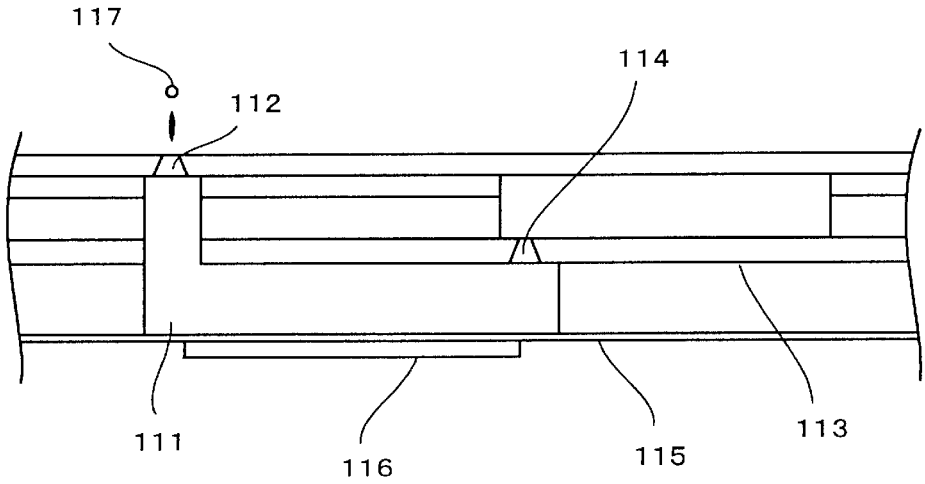
Prior Art Fig. 11
FIG. 11 shows the basic structure of an ink jet recording head of the prior arts.
Figure 12A:
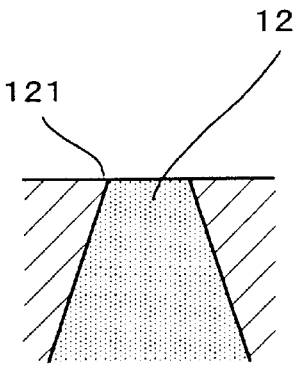
FIGS. 12*a* through 12*f* provide a model illustrating the movements of a meniscus during a re-filling operation.
Figure 12B:
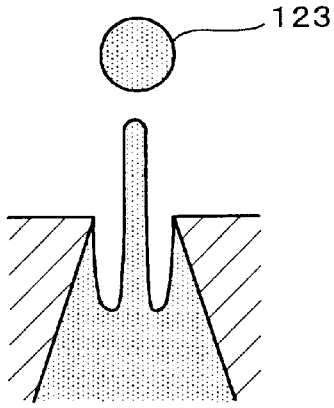
Figure 12C:
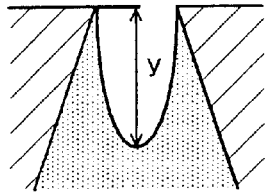
Figure 12D:
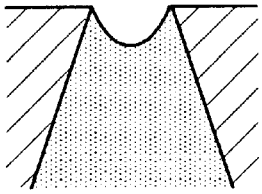
Figure 12E:
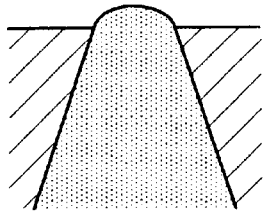
Figure 12F:
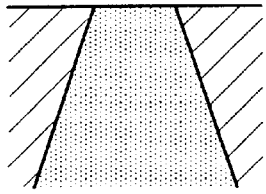
Figure 13A:
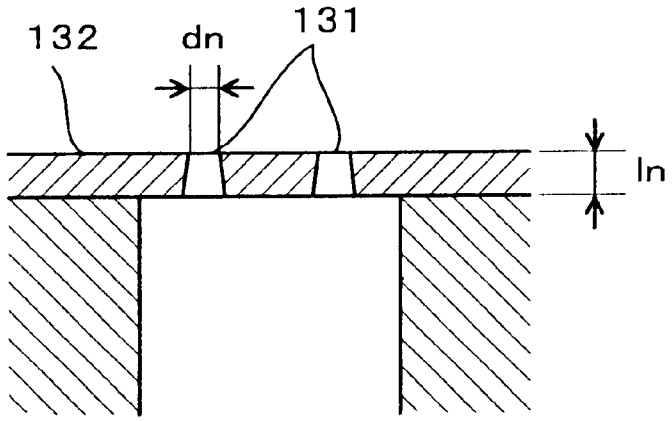
Prior Art Fig. 13a
FIG. 13*a* shows a cross-section and FIG. 13*b* an aerial view, of a nozzle structured with a plurality of ports according to the prior arts.
Figure 13B:
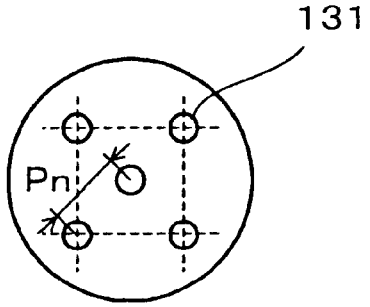
Prior Art Fig. 13b
Figure 14:
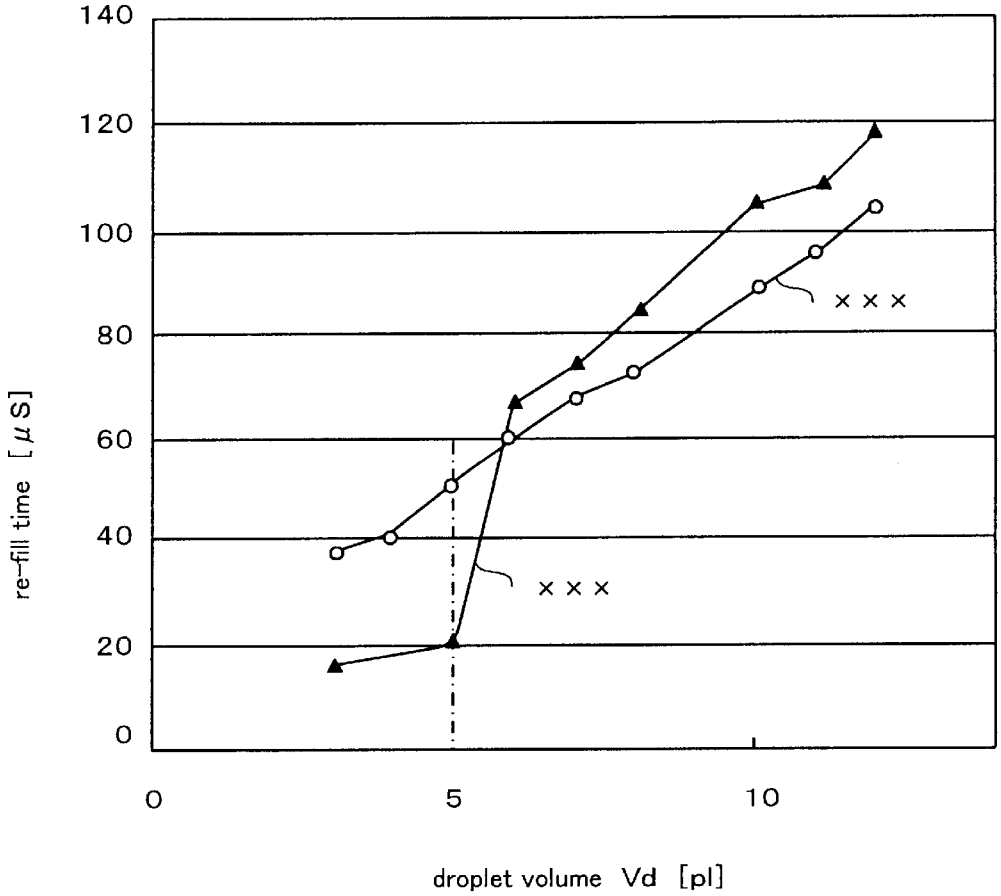
Prior Art Fig. 14
FIG. 14 shows the properties of the jetting action of an ink jet recording head having a plurality of ports according to the prior arts.
Figure 15A:
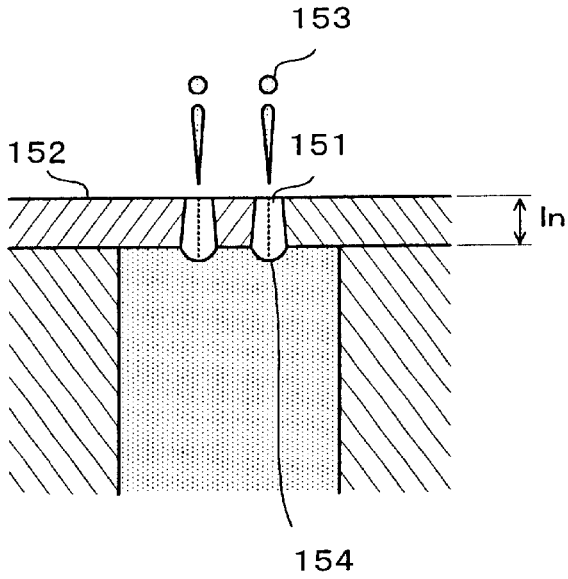
FIGS. 15*a* and 15*b* illustrate problems encountered with a nozzle structured having a plurality of ports according to the prior arts.
Figure 15B:
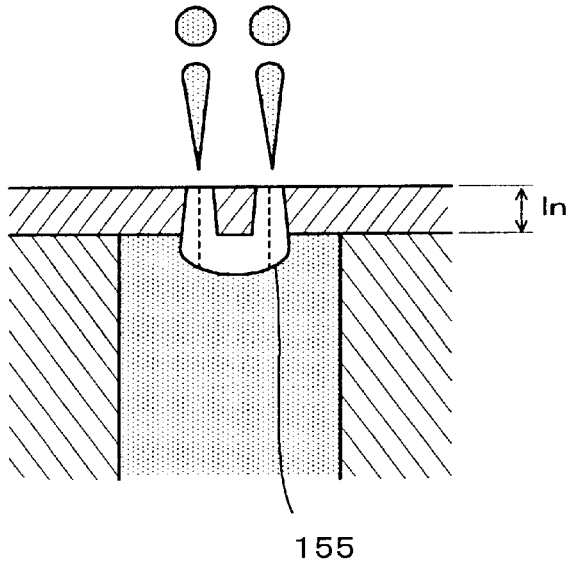

FIG. 1*a* and FIG. 1*b* show the structure of a nozzle of an ink jet recording head according to the first embodiment of the present invention. In these drawings the basic structure of the ink jet recording head overall is the same as the structure of the ink jet recording head according to the prior arts shown in FIG. 11. An ink jet recording head according to the first embodiment of the present invention will now be described with reference to FIGS. 1*a*, 1*b* and 11.

An ink jet recording head according to the first embodiment of the present invention is produced by laminating together with adhesive a plurality of thin sheets in which holes are formed through etching etc. In this embodiment stainless-steel sheets of a thickness of 50–150 $\mu$m are joined together using an adhesive like a heat resistant resin for example, approximately 5 $\mu$m thick.

In the ink jet recording head a plurality of pressure generating chambers 111 (in FIG. 11 arranged perpendicularly with respect to printing sheet) are formed, these communicating through common ink passages 113. Common passages 113 are in communication with ink tanks not shown in the drawing, and act to direct ink to each pressure generating chamber 111.

Each pressure generating chamber 111 communicates with common ink passages 113 via ink supply passages 114 and is filled with ink. In this embodiment ink supply passages 114 are formed by press processing.

Vibration plate 115 is on the bottom of pressure generating chamber 111 and this plate can expand or contract the pressure generating chamber in accordance with a pressure generating means installed on the outside of pressure generating chamber 111 that is a piezo-electric actuator (a piezo-electric vibrator).

A stainless steel plate 10 $\mu$m thick is used for vibration plate 115. Single sheet piezo-electric ceramics 30 $\mu$m thick is used for piezo-electric actuator 116. If a driving voltage wave is applied to piezo-electric actuator 116 it bends and changes shape making pressure generating chamber 111 expand or contract. If a change occurs to volume of pressure generating chamber 111 pressure waves arise inside that chamber. Ink inside nozzle 112 moves in response to the action of these pressure waves forming ink droplets 117 as ink is expelled from the nozzle.

Nozzle 112 is formed by irradiating polyimide film about 30 $\mu$m thick with an excimer laser. As shown in the aerial view provided in drawing 1*b*, one nozzle is formed from 4 ink jet ports 11. The opening portion of an ink jet port 11 is 18 $\mu$m (with an opening space area of $A_n=2.5\times10^{-10}m^2$), being a tapered opening having a length of ($l_n$) 30 $\mu$m and a tapered angle of 9 degrees. Ink droplets expelled from each such opening having volume of 5 pl ($V_d=5\times10^{16}m^3$, ink droplet diameter $d_d=21.2$ $\mu$m.) The interval $P_n$ between the four ink jet ports is 30 $\mu$m.

Besides forming a nozzle using laser processing as described for this embodiment other methods such as pressing or electroforming may also be employed. Because a high degree of precision is required for the dimensions of each ink jet port on a multi-port nozzle however, the most effective method for use on the resinous film is laser processing as described for this embodiment.

As it is clear from the description of the dimensions of an ink jet port above, an ink jet recording head according to this embodiment conforms with the conditions of equation (2). For that reason, after ink droplets are jet expelled, as shown in drawing 15*b* a fusion phenomena affecting a meniscus does not appear enabling realization of high-speed refilling.

Figures 2, 3:
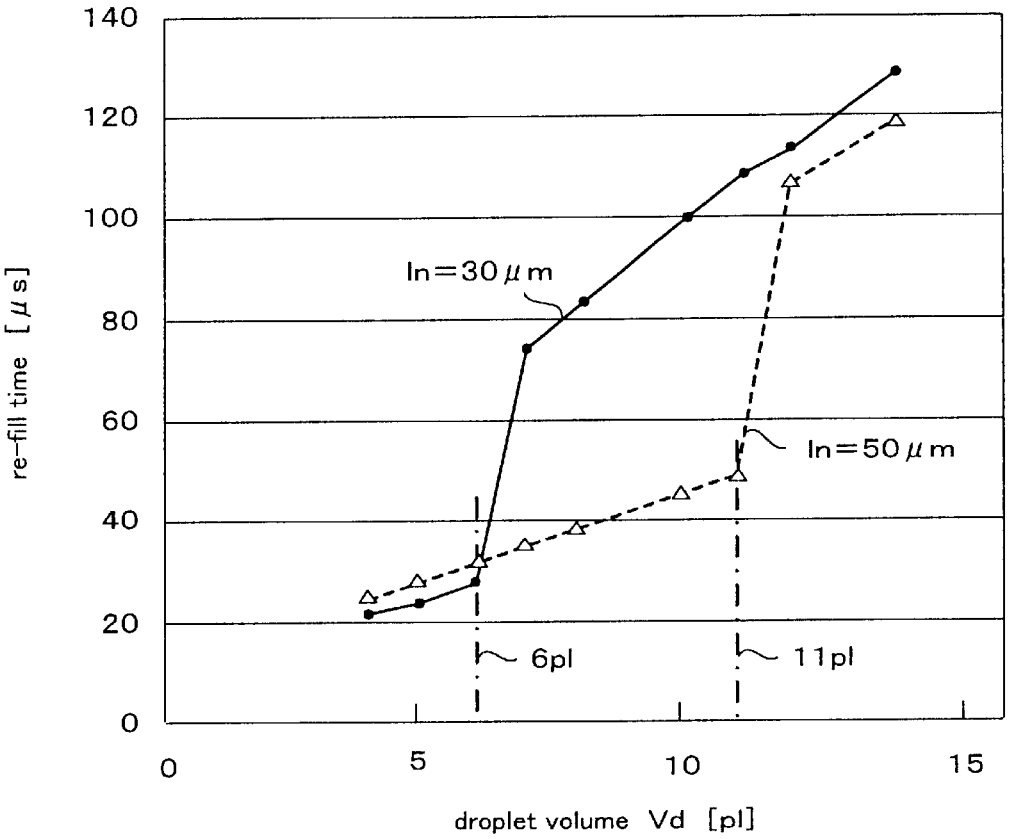
FIG. 2 is the first drawing showing the properties of the jetting action of an ink jet recording head according to a first embodiment of the present invention.
FIG. 3 is the second drawing showing the properties of the jetting action of an ink jet recording head according to a first embodiment of the present invention.

FIG. 2 is a graph showing the results of an investigation into the relationship between the volume $V_d$ of ink droplets jetted and re-fill time for an ink jet recording head according to the first embodiment of the present invention. For ink jet droplets of 6 pl or below, in accordance with the conditions established in equation (2) re-fill time is 20–30 $\mu$s so in contrast to achieving an extremely high-speed re-fill, where ink droplet volume is 7 pl or above, there is a substantial increase in re-fill time required. Further, where the length of an ink jet port is expanded up to 50 $\mu$m it has been confirmed that high-speed re-filling can be realized up to 11 pl. In other words, re-filling speed is dependent on ink jet port length and it has been confirmed that setting the length of an ink jet port to comply with the conditions of equation (2) is an indispensable condition for realizing high-speed re-filling.

The required length of an ink jet port may vary somewhat according to the pitch and taper angle of the ink jet port, however the results of assessments conducted on a variety of nozzle shapes have confirmed that the effect of the pitch and taper angle of an ink jet port is extremely small within a practical range for an ink jet port pitch of 15–50 $\mu$m and a taper angle of 0.15 degrees and that provided the conditions of equation (2) are satisfied the fusion phenomena can be suppressed almost entirely.

Because inertance and acoustic resistance of an ink jet port increase as the length of an ink jet port increases leading to an increase in re-fill time, it is preferable not to make an ink jet port longer than is necessary. Accordingly, the ideal length of an ink jet port should be set to the minimum length enabling suppression of the fusion phenomena of a meniscus, in other words $l_n=1.2\ V_d/A_n$ or at least within the scope of $l_n<4.0\ V_d/A_n$.

Again, an ink jet recording head according to the first embodiment of the present invention has ink jet port pitch ($P_n$) set at 30 $\mu$m, satisfying the conditions of equation (3). In other words, because sufficient space is provided between each ink jet port in relation to droplet diameter ($d_d$) of jetted droplets, the resulting conditions are such that it is difficult for ink droplets jetted from each ink jet port to fuse together while in flight.

Referring to FIG. 3, an experiment was conducted to record heads after making alterations to ink jet port pitch $P_n$ and ink droplet diameter $d_d$. In FIG. 3, double circles, circles, triangles, crosses and double crosses illustrate the extent to which the fusion phenomena of ink droplets occurs. Each double circle indicates conditions wherein the fusion phenomena is virtually not occurring while each double crosse represents conditions wherein the occurrence is severe. The results of the assessment conducted as shown in FIG. 3, show that under conditions $P_n$=30 $\mu$m, the fusion phenomena of droplets did not occur with droplet volume at 5 pl ($d_d$=21.2 $\mu$m), however, where droplet volume was 6 pl or above (droplet diameter 22.5 $\mu$m) the fusion phenomena became very noticeable in line with that increase in droplet volume. Further, where pitch $P_n$ is expanded to 40 $\mu$m, up to 12 pl ($d_d$=28.4 $\mu$m), it was confirmed that the fusion phenomena of droplets can be suppressed. That is to say, in order to suppress the fusion phenomena of droplets it is essential that ink jet port pitch $P_n$ be set at the optimum value in relation to ink droplet volume (droplet diameter). Basically, this confirms that the fusion phenomena of droplets is preventable provided pitch $P_n$ is set to comply with the conditions of equation (3).

With an ink jet recording head according to the first embodiment of the present invention the droplet speed of ink droplets (the speed at which they fly when jetted) as they are jetted from each ink jet port is set large at 6 m/s. This is to prevent stimulating the fusion phenomena of ink droplets occurring because the trajectory of ink droplets may change due to the effects of airflow operating between the ink jet recording head and the printing sheet. The required droplet speed for preventing the effects of such airflow vary according to the volume of ink droplets etc. however, where the volume of ink droplets jetted from a multi-port nozzle is within the range of 3–10 pl, the assessments conducted through experiments have made it clear that by setting droplet speed to 5 m/s or above the effects of airflow can be suppressed almost entirely.

As described, for the first embodiment according to the present invention the volume of ink droplets jetted from each ink jet port was set at 5 pl. This is the minimum ink droplet volume required to obtain the target image density, an OD value of 1.3 or above. That is to say, because recording resolution for this embodiment is set at 600 dpi, resulting dot pitch on the printing sheet is approximately 41 $\mu$m. This means an area of 41×41 $\mu m^2$ must be filled by ink droplets jetted from 4 ink jet ports. The results of the assessment of the recordings make it clear that when doing a Beta recording image density of an OD value of 1.3 is obtainable by setting the volume of ink droplets jetted from each ink jet port at 5 pl.

Figure 4:
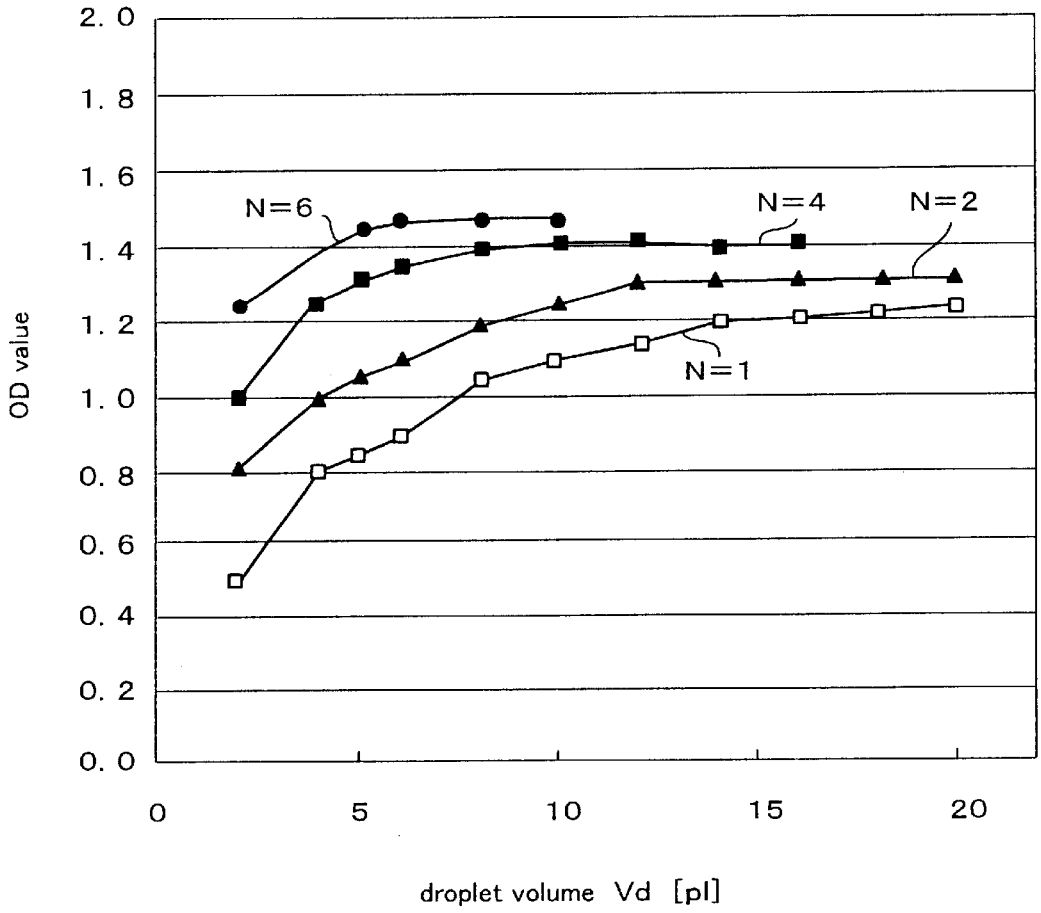
FIG. 4 is the third drawing showing the properties of the jetting action of an ink jet recording head according to a first embodiment of the present invention.

FIG. 4 shows the results of an investigation into the relationship between ink droplet volume (total volume of ink droplets jetted from ink jet ports) and image density. The square plots show the results when the recording is performed using a mono-port nozzle (N=1) having a single ink jet port. In contrast to a mono-port nozzle where ink droplet volume of 24 pl is required to obtain an OD value of 1.3, for a multi-port nozzle (n=4) an OD value of 1.3 is obtained at 5 pl×4=20 pl.

The results of the assessment of the experiment conducted with different ink types and recording resolution show that when ink of ordinary coloring and pigment is used, if ink droplet volume $V_d$ jetted from a multi-port nozzle is set in accordance with the following conditions satisfactory image density is obtainable (N is the number of ink jet ports, $V_d'$ is required ink volume for ink droplets jetted from a single ink jet port).

$$1.1V_d'/N^{3/2} < V_d < 1.8V_d'/N^{3/2} \tag{5}$$

For example, while droplet volume of 24 pl is necessary to obtain the required density from a mono-port nozzle, with a multi-port nozzle N=4, an equivalent image density is obtainable if ink droplets jetted from each ink jet port is 3–5 pl. That is to say a reduction of 1/2–5/6 is obtainable in comparison to the total required ink droplet volume (=$V_d$× N) with a mono-port nozzle. To realize a reduction in total ink droplet volume with a mono-port nozzle it is preferable to ensure the number of ink jet ports (N) is 3 or more.

As described above, by setting the volume of ink droplets jetted from each ink jet port at the minimum required it is possible to reduce re-fill time while maintaining satisfactory image density. Further, this reduction in ink droplet volume is also effective for preventing rear surface recording of the recorded image, reducing volume of ink consumed and improving drying properties. In fact, results of recording of images with an ink jet recording head according to this embodiment confirmed that rear surface recording was extremely low and so even double sided printing can be accommodated sufficiently.

Further, with an ink jet recording head according to the first embodiment of the present invention the relationship of equation (4) is created existing between inertance $m_i$ of ink supply passages and inertance $m_n$ of ink supply ports. This is because re-fill speed is increased without a deterioration in the efficiency of ink jetting. That is to say, as shown by the following equation, jetting efficiency $\eta_e$ is proportional to the ratio of total nozzle inertance $m_n$ and inertance $m_i$ of ink supply passages.

$$72\ {}_e^{\propto}\ m_i/(m_i+m_n) \tag{6}$$

Further, re-fill speed can be speeded up to the extent that inertance of nozzles and ink supply passages ($m_n'+m_i$) is reduced. In other words, reducing inertance $m_i$ of ink supply passages is effective for increasing re-fill speed, however this invites deterioration of jetting efficiency $\eta_e$. Accordingly, in ink jet heads according to the prior arts, inertance of ink supply passages is set so that $m_n=m_i$.

Figure 5:
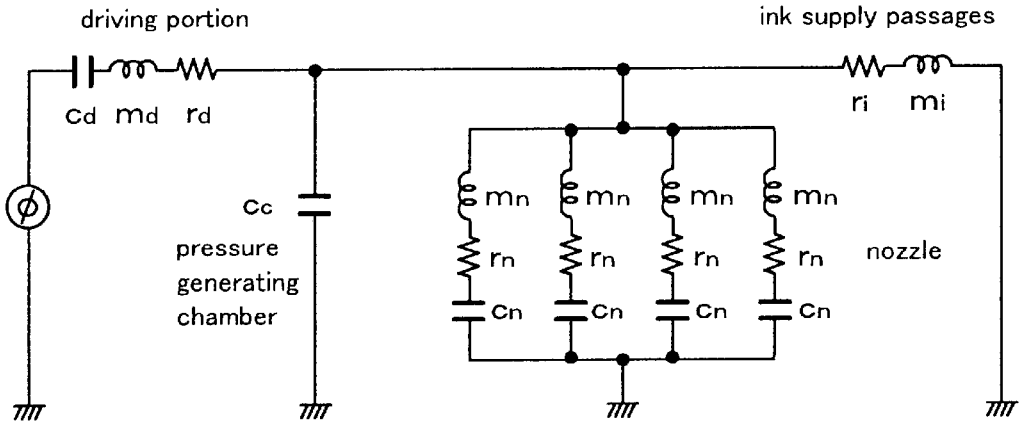
FIG. 5 shows equivalent electronic circuits of an ink jet recording head having a multi-port nozzle.

If a nozzle is made with a multi-port structure the nozzle portion forms a parallel circuit as shown in FIG. 5 and total nozzle inertance $m_n'$ is $m_n'/N$. Accordingly, if inertance of ink supply passages is set to be virtually equivalent to $m_n/N$ then ($m_n'+m_i$) can be reduced without creating a deterioration in jetting efficiency thereby enabling re-filling to be sped up. In other words, by providing a multi-port structure for a nozzle and ensuring inertance of ink supply passages is set in accordance with equation (4) re-fill speed can be increased in comparison to that for a head with a mono-port nozzle. According to results of assessments of experiments conducted by the inventor of the present invention if values are set within the ambit of equation (4), both improved jet efficiency and improved re-fill time can exist together, without making total nozzle inertance $m_n'$ conform perfectly to $m_n/N$.

As described, an ink jet recording head according to the first embodiment of the present invention realizes faster re-filling speeds through 3 devices: (a) by preventing the fusion phenomena of a meniscus at the rear surface of a nozzle through optimizing the length of ink jet ports on a multi-port nozzle; (b) by having ink droplet volume set to the required minimum and (c) by having ink supply passages set to the minimum allowable within a range that does not lead to a deterioration in jetting efficiency.

The result is that with an ink jet recording head according to this embodiment when jetting ink droplet volume of 20 pl (=5 pl×4) re-fill time is as small as 25 μs. On the other hand, with a nozzle having a single port structure, to achieve equivalent image density droplet volume of 24 pl would be required, moreover, because inertance of ink supply passages is approximately 1.5 times what it would be with a multi-port nozzle, re-fill time is approximately 55 μs. That is to say, with an ink jet recording head according to this embodiment re-fill time is approximately ½ in comparison to a mono-port nozzle according to the prior parts, thereby enabling a maximum re-fill action frequency that is approximately double.

For a nozzle simply provided with a multi-port structure, but not employing the effects of (b) and (c) above, re-fill time was only able to be reduced to 35 μs. That is to say, it was confirmed that with an ink jet recording head according to the present invention, the combined effects of the three devices of having a nozzle provided with a multi-port structure, reducing ink supply volume and optimizing settings for inertance of ink supply passages, enable refill time to be reduced beyond that which was conceivable in the past.

Figure 6A:
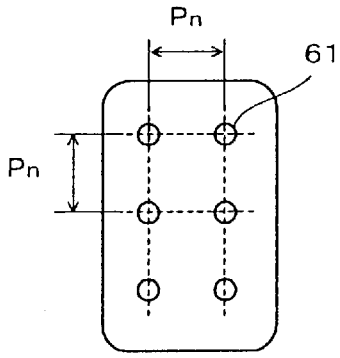
FIG. 6*a* shows the structure of a nozzle of an ink jet recording head according to the second embodiment of the present invention and FIG. 6*b* shows the distribution of recording dots.
Figure 6B:
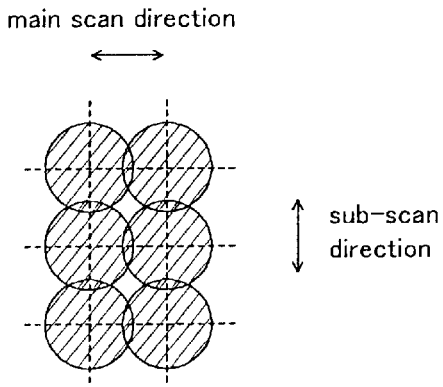

FIG. 6 a shows the structure of a nozzle of an ink jet recording head according to the second embodiment of the present invention and FIG. 6*b* shows the distribution of recording dots. The number of ink jet ports in each nozzle has been increased to 6, the difference in relation to the nozzle according to the first embodiment being the point that the configuration of the nozzle has been changed in relation to the main scan direction (the scan direction of the head) and the sub-scan direction (paper feed direction).

That is to say, with an ink jet recording head according to the second embodiment of the present invention recording resolution is 600 dpi (main scan direction)×300 dpi (sub-scan direction) and recording resolution in the sub-scan direction is reduced. This is because the scanning frequency of the head when outputting one sheet of image is reduced thereby increasing recording speed. However, if resolution of the sub-scan direction is reduced, extremely large ink droplet volume would be required to obtain a sufficient recording density. This means that with a mono-port nozzle head if resolution of the sub-scan direction is reduced from 600 dpi to 300 dpi ink droplet volume required to obtain image density of OD 1.3 increases from approximately 24 pl to approximately 35 pl. The result is an increase in re-fill time from approximately 55 μs to 80 μs, which creates impediments against an ink jet head being driven at high frequency.

Thus, with an ink jet recording head according to the second embodiment of the present invention, as shown in FIG. 6*a*, the number of ink jet ports 61 of a nozzle arranged in the main scan direction and sub-scan direction is changed. By arranging ink jet ports 61 in this way recording dots formed by ink droplets jetted from one nozzle can be made into a rhomboidal form as shown in FIG. 6*b* enabling a pixel space of 600×300 dpi to be efficiently filled. With this embodiment, by jetting ink droplets of 4 pl from each ink jet port image density of OD 1.3 can be obtained. In other words, the droplet volume required to obtain an equivalent image density can be reduced by approximately 32% in comparison to volume required for a mono-port nozzle head.

Re-fill time for an ink jet recording head according to the second embodiment of the present invention is short at 22 μs enabling stable recording to be performed at 40 kHz, 3 times the driving frequency of a mono-port nozzle head. The nozzle length, nozzle pitch and inertance of ink supply passages of an ink jet recording head according to this embodiment also, satisfy the conditions of equation (2), (3) and (4) respectively.

Further, because as described above required ink droplet volume can be substantially reduced with an ink jet recording head according to this embodiment, substantial benefit also accrues to preventing rear surface recording, (a phenomena in which ink permeates through to the rear surface of the printing sheet), in an output image. That is to say, because an extremely high volume of ink droplets is required when making a low resolution recording using a mono-port nozzle head the phenomena of rear surface recording occurs with intensity. In contrast to this, with an ink jet recording head according to this embodiment, because the required ink droplet volume can be substantially reduced the rear surface recording phenomena can be suppressed. In fact, rear surface recording is virtually absent in an image output by an ink jet recording head according to this embodiment enabling double sided printing to be performed satisfactorily.

As described above, with an ink jet recording head according to the second embodiment of the present invention, because the arrangement of ink jet ports is optimized in relation to recording resolution, dots recorded are arranged on the recording medium at substantially equivalent intervals enabling the required image resolution to be achieved with a smaller volume of ink droplets. The result is that a substantial contribution can be achieved towards improving recording speed (reducing re-fill time), preventing rear surface recording and improving drying speed etc.

Figure 7:
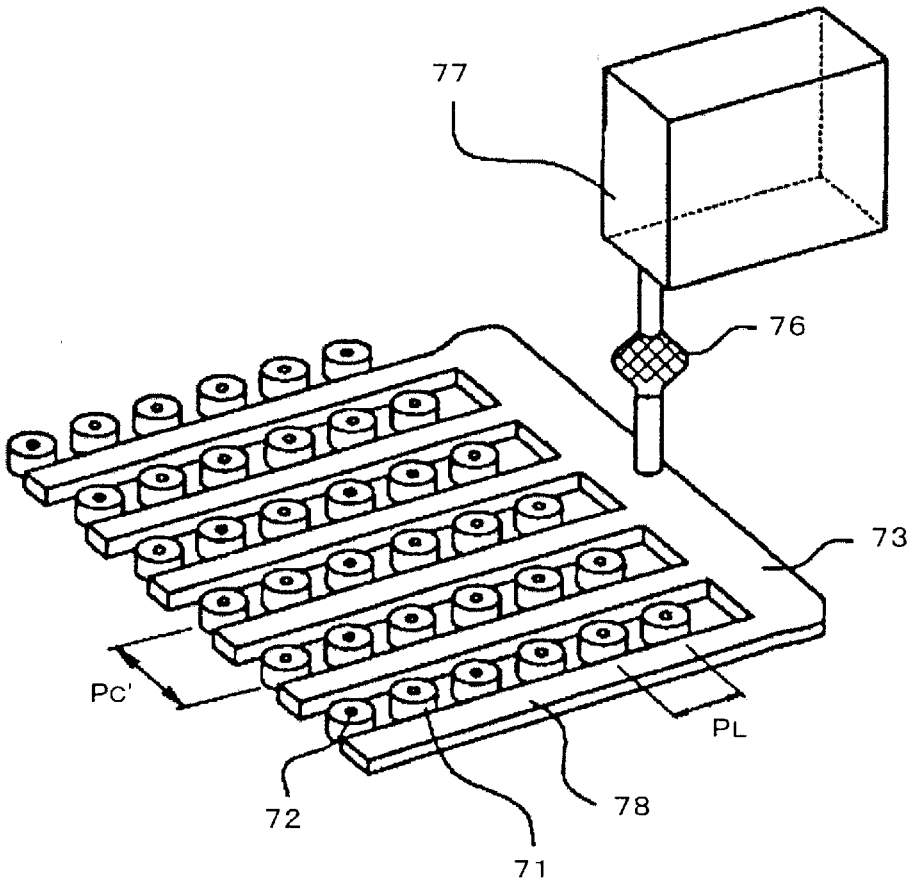
FIG. 7 shows an ink jet recording head according to a third embodiment of the present invention.

FIG. 7 provides a strabismic view of an ink jet recording head according to the third embodiment of the present invention. The structure of the ejectors which jet ink droplets and the multi-port nozzle structure are the same as for the first embodiment, however an ink jet recording head according to this third embodiment is distinguished in that it provides a two-dimensional matrix arrangement of the ejectors. Arranging the ejectors in a matrix like this is beneficial for suppressing the fusion phenomena of droplets between ejectors and enables an improvement in the image quality of images output.

With an ink jet recording head according to the third embodiment of the present invention common ink passages connecting each ejector are formed of branch ink supply passages 78 and main ink supply passages 73, with ejectors being connected to each branch ink supply. For this embodiment there are 6 branch ink supply passages 78, with 6 ejectors being connected to each branch supply, providing an arrangement of 36 individual ejectors. There is no limit on this number however, and if there were a configuration with 24 branch supply passages and 8 ejectors connected to each it would be possible to have an arrangement of 192 individual ejectors.

Figure 8:
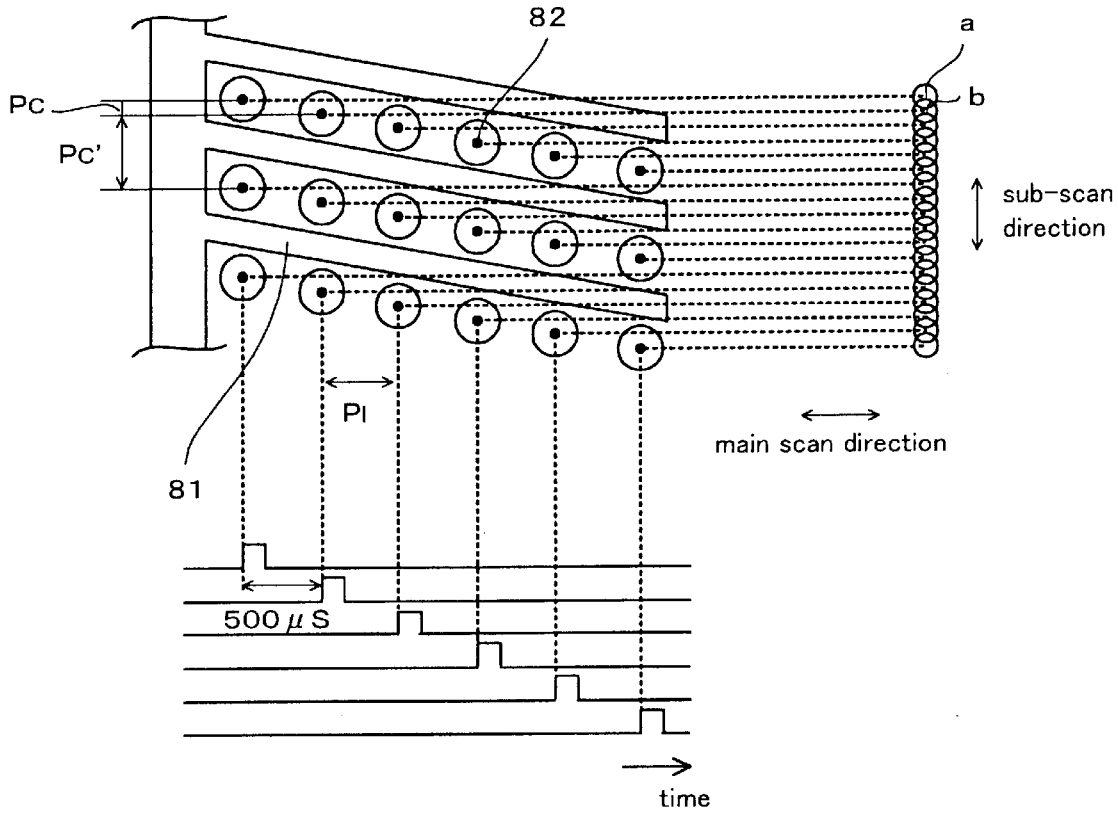
FIG. 8 shows the relationship between dots formed, jet action timing on each row and the nozzle arrangement according to the third embodiment of the present invention.

FIG. 8 shows the relationship between the arrangement of a nozzle of an ink jet recording head according to the third embodiment of the present invention, the dots formed on a printing sheet and the jet action timing of each row of ejectors. Pressure generating chambers 82 connected to the same branch ink supply passages 81 are each arranged with $P_c$ (=$P_c'$/n; n is number of ejectors connected to branch ink supply) only staggered in the sub-scan direction, with pitch $P_c$ dots being formed by the staggered jet action timing of each row for the main scan operations of the head. For this embodiment, distance between rows $P_L$ is set at 500 μm and scanning speed of the head is set at 1 m/s. Accordingly, by staggering jet action timing of each row 500 μs for the ink jetting process, dots can be applied in the same position in relation to the main scan direction.

In this way, with an ink jet recording head according to the third embodiment of the present invention, ink jetting action is performed at a different timing from each row of ejectors thereby enabling substantial space to be maintained between ink droplets forming neighboring dots. That is to say, because in FIG. 8 dot b is formed 500 μs later than dot a, a 3 mm distance arises between ink droplets forming dot b and dot a, thus where the flight distance of jetted ink is 1 mm, at the point in time at which ink droplets forming dot b were jetted, ink droplets forming dot a were already applied. In this way, because a substantial distance is maintained between ink droplets forming neighboring dots, the fusion phenomena of ink occurring between each ink droplet can be effectively suppressed thereby realizing a significant improvement in quality of an image output.

Figure 9:
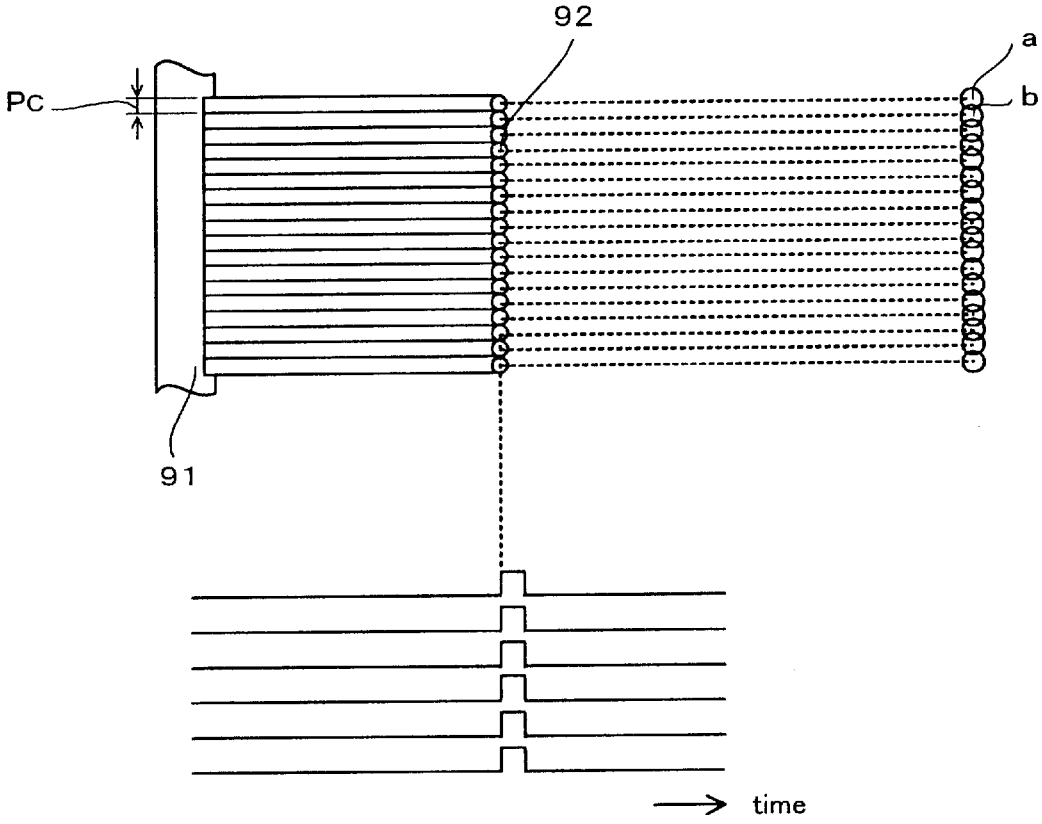
Prior Art Fig. 9
FIG. 9 shows the relationship between dots formed, jet action timing on each row and the nozzle arrangement in an ink jet recording head of the prior arts.

As shown in FIG. 9, to provide a comparison an experiment was conducted using a head structured of ejectors in a one-dimensional arrangement. Ink was jetted from all ejectors at the same time. This means that dot a and dot b were formed simultaneously and the distance when the droplets forming both those dots were being jetted was small at tens μm so that conditions were very conducive to the occurrence of the fusion phenomena. In fact, in images output using this head there was a prolific occurrence of unevenness in the image caused by the fusion phenomena of droplets, confirming that in comparison to images produced using ejectors arranged in a matrix, there was clearly a deterioration in image quality.

As described above, with an ink jet recording head using a multi-port head, if ejectors are arranged in a two-dimensional matrix a substantial distance can be maintained between ink droplets forming neighboring dots which is beneficial for preventing the fusion phenomena of ink droplets and enables images of superior quality to be produced. In other words, with an ink jet recording head of this embodiment, because it is possible to make high quality recordings even where the distance $P_n$ between ejectors is set relatively small, an ink jet recording head with nozzles arranged in a high-density configuration can be realized.

Figure 10A:
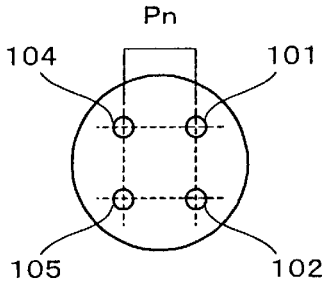
FIGS. 10*a* and 10*b* show the structure of a nozzle of an ink jet recording head according to the fourth embodiment of the present invention.

FIG. 10*a* shows the structure of a nozzle of an ink jet recording head according to the fourth embodiment of the present invention. The number and arrangement of ink jet ports is the same as for the first embodiment however this embodiment is distinguished in that small changes to the diameter of the opening of each ink jet port have been made. That is to say, with an ink jet recording head according to the fourth embodiment of the present invention, by combining ink jet ports that have differing diameters for their respective openings in a nozzle having a multi-port structure, the speed of ink droplets being jetted from each ink jet port changes thereby suppressing the fusion phenomena of ink droplets in flight during the jetting process.

With the fourth embodiment of the present invention, diameters of the openings of ink jet ports 101, 102, 103 and 104 are set at 15 μm, 16 μm, 17 μm and 18 μm respectively. The results of observations of ink jetting action measuring the speed of ink droplets jetted from ink jet ports 101–104 respectively were 6.0 m/s, 6.7 m/s, 7.6 m/s and 8.6 m/s (speed being largely an inverse ratio of the area of the opening of an ink jet port). In other words, a difference in droplet speed of 0.7 to 2.6 m/s exists between ink droplets jetted from the respective ink jet ports and accordingly at the point in time at which ink droplets are applied to the recording sheet a distance of 120 to 315 μm is maintained between each ink droplet (calculating flying distance of jetted ink at 1 mm).

Figure 10B:
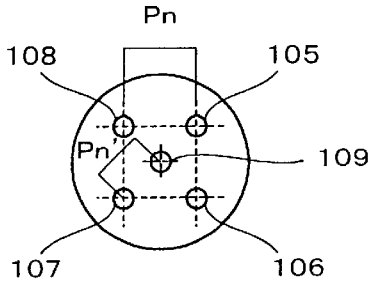

As described above, by combining ink jet ports having differing diameters for the respective openings as in this embodiment, the distance between ink droplets jetted from each ink jet port can be expanded, thereby suppressing the fusion phenomena between each ink jet droplet more effectively. In fact, it has been confirmed that in images output using the head of this embodiment a higher degree of consistency is achieved than in images output using the head according to the first embodiment and there is more effective suppression of the fusion phenomena of ink droplets.

Where ink jet ports having different diameters for their respective openings are used as required for this embodiment, the fusion phenomena of droplets can be suppressed even where the conditions of equation (3) are not satisfied. For example, if an ink jet port with an opening of small diameter is arranged in the middle as in FIG. 10*b*, ink droplets jetted from ink jet port 109 fly faster than ink droplets jetted from ink jet ports 105 through 108 so the fusion phenomena of ink droplets does not occur. Accordingly, if $P_n$ satisfies the conditions of equation (3) the fusion phenomena of ink droplets can be suppressed even where the smallest pitch $P_n'$ of an ink jet port does not satisfy conditions of equation (3).

The number of ink jet ports and the combining of ink jet ports having openings of differing diameters is not restricted to what has been shown for this embodiment. For example an ink jet port with a large opening could be positioned for ink jet port 109 of drawing 10*b* and diameters of the openings of ink jet ports 105 through 108 could each be set at differing values.

Where ink jet ports having different diameters for their respective openings are used as in this embodiment, inertance $m_i$ of ink supply passages must be set so as to satisfy the conditions of the following equation.

$$0.5 \le \frac{1}{m \cdot \sum_{i=1}^{N} \frac{1}{m_n}} \le 1.5 \tag{7}$$

However, where diameter of openings of ink jet ports is within the ordinary range (15–25 μm), there is no problem if the average inertance of an ink jet port is used requiring an mi setting within the range of equation (4).

The present invention is not restricted however to the structures of each of the embodiments as described hereinbefore. For example, in the embodiments described above a piezo-electric actuator is used as a pressure generating means, however it is possible to use a different kind of pressure generating means such as an electromechanical sensing element that uses static electricity or magnetic force or an electric heat sensing element that uses boiling to create pressure. Further, it is suitable to use a different kind of actuator like a longitudinal vibration type stacked piezo-electric actuator instead of the single plate type piezo-electric actuator used as a piezo-electric actuator for these embodiments.

Further, in the embodiments described above the shape of the ink jet ports is a tapered cylindrical shape however ink jet ports are not restricted to this shape only and the present invention can be equally applied where for example ink jet ports having openings with a multi angled shape are used.

Again, for the embodiments described above an ink jet recording device that jets colored ink onto a recording sheet to record text or images was taken as an example, however ink jet recording of these embodiments is not confined to recording text or an image on a paper sheet. That is to say, the recording medium is not limited to paper only neither is the jetted liquid restricted to colored ink. For example, the present invention can be used for a general liquid droplet jet injection device used in industry such as for producing a color filter for a display by jetting colored ink onto polymeric film or glass, or jetting molten solder onto a substrate for forming bumps for component mounting.

As described above the present invention brings out to the maximum the faster re-filling speed that is the benefit of a multi-port nozzle, thereby realizing faster recording than that achieved by ink jet heads of the prior arts. According to the present invention, the fusion phenomena occurring as ink droplets jetted from a multi-port nozzle fly out as they are jetted can be suppressed thereby enabling recording of excellent quality images.

What is claimed is:

1. An ink jet recording head wherein pressure changes are induced in an ink filled pressure generating chamber through a pressure generating means and ink droplets are jetted from a nozzle communicating with said pressure generating chamber and wherein said nozzle is structured of a plurality of ink jet ports, the length of which ports $l_n$ [m] is set in accordance with the following conditions:

$$l_n > 1.2 V_d / A_n$$

where $V_d$ is the volume of ink droplets that are jetted from one individual ink jet port [$m^3$] and $A_n$ is the area of a nozzle opening [$m^2$].

2. The ink jet recording head according to claim 1 wherein the length $l_n$ [m] of each said ink jet port is set so as to satisfy the following conditions:

$$l_n > 4.O\ V_d / A_n.$$

3. The ink jet recording head according to claim 1 wherein the volume of ink droplets $V_d$ jetted from each said ink jet port is set so as to satisfy the following conditions:

$$1.1 V_n'/N^{3/2} > V_d > 1.8 V_d'/N^{3/2}$$

where $V_d'$ is required ink volume when ink droplets are jetted from a single ink jet port.

4. The ink jet recording head according to claim 1 wherein said speed of jetted ink droplets is set to 5m/s or less.

5. The ink jet recording head according to claim 1 wherein nozzles are arranged in a two dimensional matrix.

6. The ink jet recording head according to claim 1 wherein there are 3 or more ink jet ports.

7. The ink jet recording head according to claim 1 wherein said ink jet ports are formed by laser processing.

8. The ink jet recording head according to claim 1 wherein said ink jet ports are arranged in relation to the recording resolution of the scanning direction and sub-scanning direction of the head such that recording dots formed from ink droplets jetted from said ports are arranged on the recording medium at substantially even intervals.

9. An ink jet recording head according to claim 1 wherein said openings of said plurality of ink jet ports of various diameters.

10. An ink jet recording device installed with an ink jet recording head according to claim 9.

11. An ink jet recording device installed with an ink jet recording head according to claim 1.

12. An ink jet recording head wherein pressure changes are induced in an ink filled pressure generating chamber through a pressure generating means and ink droplets are jetted from a nozzle communicating with said pressure generating chamber and wherein said nozzle is structured of a plurality of ink jet ports, the interval between which ports $P_n$ [m] is set in accordance with the following conditions:

$$P_n > 1.4 d_d$$

where $d_d$ is diameter [m] of an ink droplet jetted from an ink jet port.

13. An ink jet recording device installed with an ink jet recording head according to claim 12.

14. An ink jet recording head wherein pressure changes are induced through a pressure generating means in an ink filled pressure generating chamber that is connected to a nozzle and ink supply passages, which ink jet recording head jets ink droplets from said nozzle and wherein said nozzle is structured of a plurality of ink jet ports and the inertance $m_i$ of ink supply passages is set in accordance with the following conditions:

$$0.5 \leq m_n/(N/m) \leq 1.5$$

where $m_n$ is the inertance of an ink jet port and N is the number of ink jet ports.

15. An ink jet recording device installed with an ink jet recording head according to claim 14.

* * * * *